US007644678B2

(12) United States Patent
Carstens et al.

(10) Patent No.: US 7,644,678 B2
(45) Date of Patent: Jan. 12, 2010

(54) MIXING APPARATUS AND METHOD FOR THE REPAIR OF CAN ENDS

(75) Inventors: Aaron Emmanuel Carstens, Dayton, OH (US); Dennis Cornelius Stammen, Vandalia, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 461 days.

(21) Appl. No.: 11/376,390

(22) Filed: Mar. 15, 2006

(65) Prior Publication Data

US 2007/0218194 A1 Sep. 20, 2007

(51) Int. Cl.
*B05C 5/02* (2006.01)

(52) U.S. Cl. ..... 118/313; 118/315; 118/DIG. 3; 239/428; 239/419.8; 239/303; 239/304

(58) Field of Classification Search ..... 118/313, 118/315, DIG. 3; 427/421.1; 366/101; 239/428, 239/419.3, 8, 303, 304, 306, 347
See application file for complete search history.

(56) References Cited

U.S. PATENT DOCUMENTS

| | | | | |
|---|---|---|---|---|
| 3,788,547 | A * | 1/1974 | Stahl et al. | 239/129 |
| 4,752,172 | A | 6/1988 | Bolte | |
| 4,908,153 | A | 3/1990 | Kossmann et al. | |
| 5,120,410 | A | 6/1992 | Herdzina, Jr. | |
| 5,295,800 | A * | 3/1994 | Nelson et al. | 425/130 |
| 5,655,713 | A | 8/1997 | Gibney et al. | |
| 5,895,528 | A | 4/1999 | Gomariz Perez | |
| 5,904,774 | A | 5/1999 | Gomariz Perez | |
| 6,165,266 | A | 12/2000 | Garcia | |
| 6,435,854 | B1 * | 8/2002 | Sawa et al. | 425/130 |
| 6,533,189 | B2 * | 3/2003 | Kott et al. | 239/8 |
| 6,899,282 | B1 | 5/2005 | Hill | |
| 7,329,038 | B2 * | 2/2008 | Hashiba | 366/101 |
| 2002/0172760 | A1 | 11/2002 | An et al. | |

FOREIGN PATENT DOCUMENTS

| | | | |
|---|---|---|---|
| JP | 405049977 A | * | 3/1993 |
| JP | 410216571 A | * | 8/1998 |

OTHER PUBLICATIONS

Extended European Search Report issued May 4, 2009 for European Application No. 07004369.0.

* cited by examiner

*Primary Examiner*—Laura Edwards
(74) *Attorney, Agent, or Firm*—Eckert Seamans Cherin & Mellott, LLC; Grant E. Coffield, Esq.

(57) ABSTRACT

This invention generally relates to a mixing apparatus and a method useful in the repair of coating adhered on a can end used in the food and beverage packaging industry. The mixing apparatus has a plurality of holding tanks in fluid communication with a first fluid delivery system and a mixer. A pressure tank is provided which is in fluid communication with the mixer. A spray device is provided which is in fluid communication with a second fluid delivery system and the pressure tank. A plurality of liquids or fluids are flowed through the first fluid delivery system, the plurality of liquids or fluids are mixed in the mixer to yield a mixed solution which is flowed to the pressure tank and the mixed solution is flowed through the second fluid delivery system and dispensed on the can end. A method for the repair of coating adhered on a can end is provided as well.

17 Claims, 2 Drawing Sheets

MIXING APPARATUS AND METHOD FOR THE REPAIR OF CAN ENDS

FIELD OF THE INVENTION

This invention generally relates to a mixing apparatus and a method useful in the manufacture of can ends used in the food and beverage packaging industries. More specifically, the invention provides a mixing apparatus and a method for use in the corrosion preventative repair of tooling induced damage to can end coatings, which may occur to coated steel can ends during the conversion of a steel shell into a full open or easy open food or beverage can end.

BACKGROUND OF THE INVENTION

Many can bodies for food, beverages or other products are provided with easy open can ends that are characterized by having a pull tab attached to the can end which is used to fracture a tear panel on the can end defined by a score line on the can end. The pull tab may be lifted to depress the tear panel in order to provide an opening in the can end for dispensing the contents of the container.

Likewise, many food products are sold in can bodies provided with full open easy open can ends that are characterized by having a pull tab attached to the can end which is used to fracture a score line that circumscribes the circumference of the end panel to define an opening panel. The pull tab may be lifted to fracture the score line. After the score line is fractured, the pull tab may be pulled upward from the container which severs the remainder of the score line in order to remove the entire opening panel for dispensing the contents of the container.

In the manufacture of an easy open can end, a shell is conveyed to a conversion press. In the industry, a pre-converted can end is commonly referred to as a shell. In the typical operation of a conversion press, a shell is introduced between an upper tool member and a lower tool member, which are in the open, spaced apart position. A press ram advances the upper tool member toward the lower tool member in order to perform any of a variety of tooling operations such as rivet forming, paneling, scoring, embossing, and final staking. After performing a tooling operation, the press ram retracts until the upper tool member and lower tool member are once again in the open, spaced apart position. The partially converted shell is transported to the next successive tooling operation until an easy open can end is completely formed and discharged from the press. As one shell leaves a given tooling operation, another shell is introduced to the vacated operation, thus continuously repeating the entire easy open can end manufacturing process. Examples of easy open can ends can be found in U.S. Pat. Nos. 4,465,204 and 4,530,631. Conversion presses can operate at speeds that manufacture in excess of 500 can ends per minute per lane, with certain presses having four lanes of tooling manufacturing in excess of 2000 converted can ends per minute.

It has been the practice in the industry to continue to strive to reduce the starting gauge of the metal sheet stock used to form the can end. The current practice is to use metal with a starting gauge of approximately 0.008 inch (0.20 mm). As such, tooling stations in a conversion press must be rigorously maintained within prescribed operating tolerances due to the thin sheet stock used in the press. In the production of a converted can end in a conversion press, the scoring station is of particular concern. The scoring station employs a tooling member that has a knife edge which defines the tear panel or opening panel on the public side of the can end.

Steel sheet stock used in the manufacture of can ends has a coating which protects the metal by inhibiting oxidation, corrosion or rust from forming on the surface of the metal. During the conversion process, damage to the protective coating typically occurs while forming the score that defines the tear panel or opening panel of the can end. As noted above, in the conversion of a shell into a can end with openable features thereon, a score line is formed. This score line defines the tear panel or opening panel described above. The score line is the most likely location where damage is caused to the pre-conversion, protective coating. Any oxidation, corrosion or rust on the surface of the can end represents an unattractive product appearance to the consumer and is unacceptable to canmakers in general.

In the industry, as a precautionary measure to prevent oxidation, corrosion or rust from appearing on the can end, many canmakers apply a mixed solution to the scored area of the can end by spraying the can end. The accepted spraying apparatus and method in the industry for score repair on full open easy open ends utilizes a single holding tank that holds a plurality of components (e.g., solvent and epoxy) that are flowed through a fluid delivery system and a spray apparatus for applying the mixed solution to the can end.

These score repair machines use many different variations of two or more component epoxy mixtures for the application of mixed solution to the score lines of the can end. The fluid delivery systems require routine maintenance because the two or more component mixed solution has a finite tank life when mixed and need to be cleaned or purged from the machine when the mixed solution expires. The existing fluid delivery systems pump mixed solution and the mixed solution wets many of the pumping components and auxiliary components including, by way of example and not limitation, filters, valves, pumps, pressure transducers and check valves, etc. The mixed solution has a negative effect on the overall efficiency of many components of the machine because so many components are wetted with the mixed solution and require cleaning when the mixed solution expires.

Conversely, the mixing apparatus and method of the present invention will mix the components of the mixed solution on demand. The apparatus also contains a pressure tank that eliminates the exposure of the mixed solution to the pumping components and auxiliary components used in the fluid delivery system which simplifies cleaning and maintenance of the fluid delivery system. The apparatus of the present invention does not have any high pressure pumps or repair fluid pressure regulators that contact the mixed solution and can be designed for low pressure spray devices or high pressure spray devices. The apparatus also provides the end-user with greater flexibility by being able to use different mixing ratios of the base components (e.g., 4:1—solvent: epoxy, or any other combination.) The apparatus also allows the holding tanks to be continuously replenished with liquids or fluids while the mixing apparatus is operating because the liquids or fluids are drawn from storage tanks at atmosphere.

There continues to be a need in the art for a mixing apparatus and method of the present invention that mixes components of a mixed solution on demand. Also, there continues to be a need in the art for a mixing apparatus and method of the present invention that uses a pressure tank that eliminates the exposure of the mixed solution to the pumping components and auxiliary components used in the system in order to simplify cleaning and maintenance of the fluid delivery system. Additionally, there continues to be a need in the art for a mixing apparatus and method of the present invention that can accommodate different mixing ratios of the components of the mixed solution. Also, there continues to be a need in the art for a mixing apparatus and method of the present invention that allows holding tanks to be continuously replenished with liquids or fluids while the mixing apparatus is operating.

SUMMARY OF THE INVENTION

It is an object of the present invention to provide a mixing apparatus and method that mixes repair fluid components on demand. It is an additional object of the present invention to provide a mixing apparatus and method that uses a pressure tank that eliminates the exposure of the mixed repair fluid solution to the pumping components and auxiliary components used in the fluid delivery system in order to simplify cleaning and maintenance of the fluid delivery system. It is an additional object of the present invention to provide a mixing apparatus and method that can accommodate different mixing ratios of the repair fluid components. It is an additional object of the present invention to provide a mixing apparatus and method that allows holding tanks to be continuously replenished with liquids or fluids while the mixing apparatus is operating.

Certain objects of the present invention are obtained by providing a mixing apparatus for the repair of coating adhered on a can end. The mixing apparatus has a plurality of holding tanks in fluid communication with a first fluid delivery system and a mixer. A pressure tank is provided which is in fluid communication with the mixer. A spray device is provided which is in fluid communication with a second fluid delivery system and the pressure tank. A plurality of liquids or fluids are flowed through the first fluid delivery system, the plurality of liquids or fluids are mixed in the mixer to yield a mixed solution which is flowed to the pressure tank and the mixed solution is flowed through the second fluid delivery system and dispensed on the can end.

Other objects of the present invention are obtained by providing a mixing apparatus for the repair of coating adhered on a can end. The mixing apparatus has a plurality of holding tanks in fluid communication with a first fluid delivery system and a mixer. The first fluid delivery system has a plurality of valves coupled to the holding tanks, wherein the valves selectively flow liquids or fluids held in the holding tanks into the first fluid delivery system. The first fluid delivery system also has a plurality of pumps, wherein the pumps pump the liquids or fluids to flow the liquids or fluids into the mixer. A pressure tank is in fluid communication with the mixer and a relieving type pressure regulator is coupled to the pressure tank. A spray device is in fluid communication with a second fluid delivery system and the pressure tank, wherein the plurality of liquids or fluids are mixed in the mixer to yield a mixed solution which is flowed into the pressure tank. Pressure in the pressure tank flows the mixed solution through the second fluid delivery system and dispenses the mixed solution on the can end.

Other objects of the present invention are obtained by providing a method for the repair of coating adhered on a can end. The method comprises: flowing a plurality of liquids or fluids from a plurality of holding tanks into a first fluid delivery system in fluid communication with the holding tanks and a mixer; flowing the plurality of liquids or fluids into the mixer; mixing the plurality of liquids or fluids to yield a mixed solution; flowing the mixed solution into a pressure tank; flowing the mixed solution from the pressure tank into a second fluid delivery system in fluid communication with the pressure tank and a spray device; and dispensing the mixed solution on the can end.

DETAILED DESCRIPTION OF THE PREFERRED EMBODIMENTS

Figure 1:
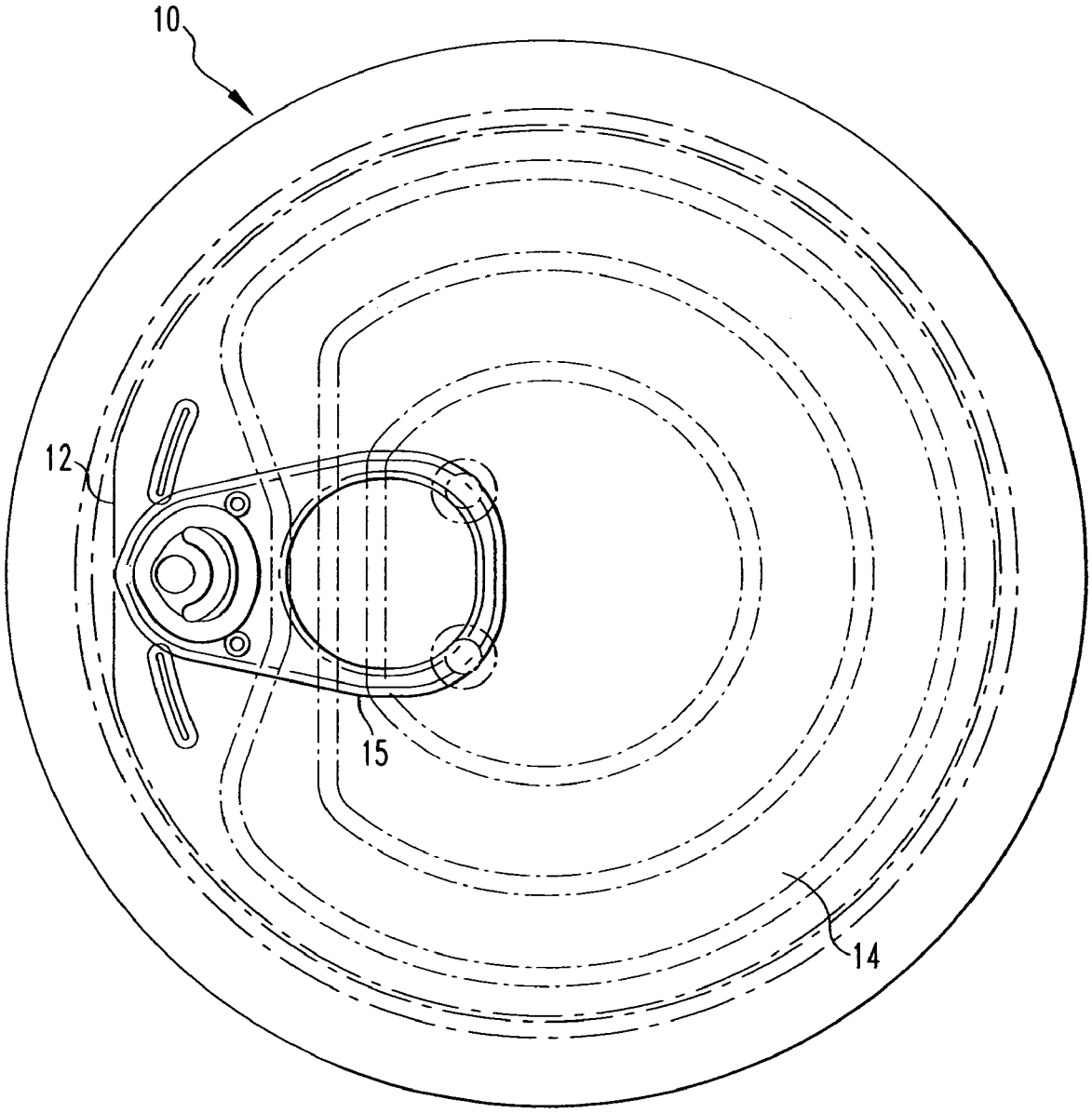
FIG. 1 is a top plan view of a full open easy opening end.

For purposes of the description hereinafter, the terms "upper", "lower", "vertical", "horizontal", "top", "bottom", "aft", "behind", "forward", "rear", "beneath", "below" and derivatives thereof shall relate to the invention, as it is oriented in the drawing FIGS. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting.

As employed herein, the term "number" refers to one or more than one (i.e., a plurality). As employed herein, the term "fastener" refers to any suitable fastening, connecting or tightening mechanism expressly including, but not limited to, integral rivets. As employed herein, the statement that two or more parts are "coupled", "attached" or "connected" together shall mean that the parts are joined together either directly or joined through one or more intermediate parts.

Turning to FIG. 1, a full open easy open can end 10 is displayed. The can end 10 has a score line 12 which defines an opening panel 14. A pull tab 15 may be lifted to fracture the score line 12. After the score line 12 is fractured, the pull tab 15 may be pulled upward from the container which severs the remainder of the score line 12 in order to remove the entire opening panel 14 for dispensing the contents of the container.

Figure 2:
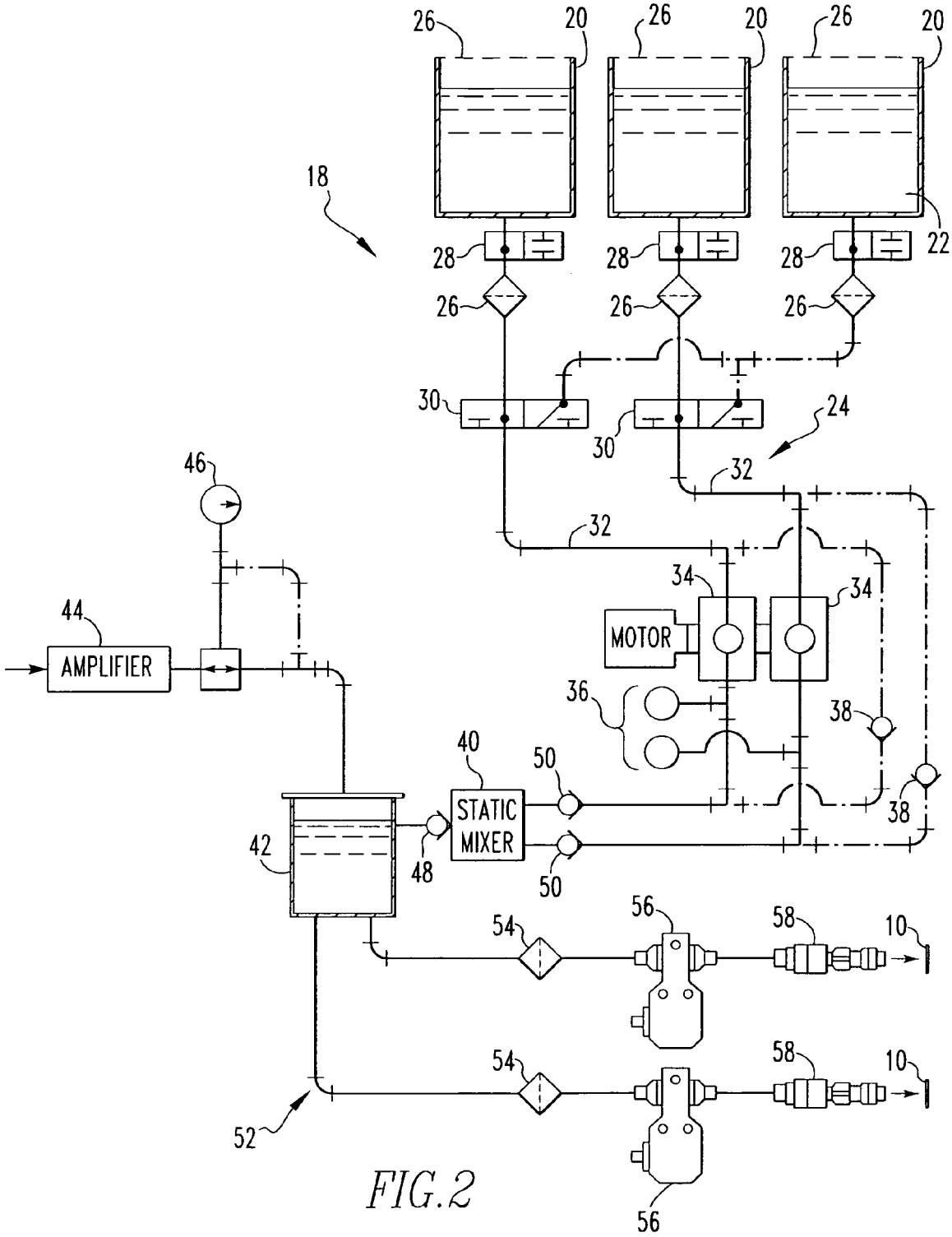
FIG. 2 is a schematic drawing of a mixing apparatus and a method for the repair of can ends.

Turning to FIG. 2, a schematic drawing of a mixing apparatus 18 and a method for the repair of can ends is shown. The mixing apparatus 18 has a plurality of holding tanks 20 for holding various liquids or components of such liquids including, by way of example and not limitation, liquid components of a repair fluid, lacquer, epoxy or paint that when mixed together yield a mixed solution. Alternatively, one of the holding tanks 20 could hold a liquid or solvent 22 for cleaning or flushing a first fluid delivery system 24 which is in fluid communication with the holding tanks 20 and a mixer 40. The liquids dispensed from the holding tanks 20 could be, by way of example and not limitation, any aqueous or organic liquid or fluid known in the art which is suitable for: (i) mixing with one or more components to yield a mixed solution; or (ii) dissolving or releasing liquids or fluids disposed within the first fluid delivery system 24. The holding tanks 20 may be continuously replenished with liquids or fluids while the mixing apparatus 18 is operating because the liquids or fluids are drawn from storage tanks at atmosphere.

The holding tanks 20 and the first fluid delivery system 24 may have filters or strainers 26 that remove contaminants from the liquids or fluids flowed into the holding tanks 20 or the first fluid delivery system 24. The first fluid delivery system 24 of the present invention may contain additional elements, by way of example and not limitation, a plurality of first valves 28, a plurality of second valves 30, a plurality of conduits, hoses or passageways 32, a plurality of pumps 34, a plurality of pressure transducers 36, a plurality of pressure relief valves 38 or a plurality of second check valves 50. The plurality of first valves 28 are coupled to the holding tanks 20 for selectively flowing the contents of one or more of the holding tanks 20 through the first fluid delivery system 24 by a programmable logic control device or other control device. The plurality of second valves 30 are coupled to the first valves 28 for selectively flowing the contents of one or more of the holding tanks 20 through the first fluid delivery system 24 by a programmable logic control device or other control device. The first fluid delivery system 24 may contain a plurality of conduits, hoses or passageways 32 for flowing the liquids or fluids held in the holding tanks 20 which are in fluid communication with the conduits, hoses or passageways 32. The conduits, hoses or passageways 32 are in fluid communication with the mixer 40. The first fluid delivery system 24 may also contain a plurality of pumps 34 coupled to the plurality of pressure transducers 36. The pumps 34 are metering pumps with an eccentric drive element for selectively applying pressure and pumping the liquids or fluids that were held in the holding tanks 20 to flow such liquids or fluids into the mixer 40 and on into a small pressure tank 42. The pressure transducers 36 coupled to the pumps 34 are used to selectively monitor the pressure in the first fluid delivery system 24 to ensure flow within the first fluid delivery system 24 between a selected value lower than the operating pressure of the mixing apparatus 18 and the limiting upper end of pressure allowed for pumps 34 by a programmable logic control device or other control device. The first fluid delivery system 24 may also contain a plurality of pressure relief valves 38 which check the first fluid delivery system 24 for blockage or obstruction downstream from the pumps 34 by a programmable logic control device or other control device. These pressure relief valves 38 are designed to mechanically relieve pressure at a value that is less than the maximum operating pressure of the pumps 34 selected. The pressure relief valves 38 protect the pumps 34 from pressure surges due to blockages or obstruction downstream while the pressure transducers 36 are shutting off motor motion to the pumps 34.

The liquids or fluids held in the holding tanks 20 flow under pressure supplied by pumps 34 through the first fluid delivery system 24 into the mixer 40 which mixes the liquids or fluids to yield a small amount of a mixed solution prior to flowing the mixed solution from the pressure supplied by pumps 34 into the small pressure tank 42 which is in fluid communication with mixer 40. The pressure tank 42 has a size of about 1 gallon (3.79 liters) whereas existing fluid delivery systems that pump mixed solution through the pumping components and the auxiliary components have a pressure tank size of about 15 gallons (56.78 liters). As can be seen, the size of the pressure tank 42 of the present invention is a substantial reduction over the size of the pressure tank in existing fluid delivery systems that pump mixed solutions. It has been found that the 1 gallon (3.79 liters) size also meets the maximum flow demands observed in operation of the mixing apparatus 18. Generally speaking, about 1 gallon (3.79 liters) per hour is about the maximum mixed solution output that has been observed, which allows for a smaller volume of mixed solution to be stored in pressure tank 42. Such an approach also avoids running pumps 34 continuously to pump the liquids or fluids from holding tanks 20 into the pressure tank 42 leading to an energy savings in the operation of the present invention. A supply of gas optionally flows into an amplifier 44 which increases the pressure of the gas. A pressure regulator 46 may be coupled to the optional amplifier 44 and coupled to the pressure tank 42 for selectively relieving the pressure of the gas in the pressure tank 42. The amplifier 44 is typically provided in those systems that use a high pressure droplet or atomization spray method on a spray device 58. The amplifier 44 is typically not provided in those systems that use a low pressure solid stream or non-atomization spray method on the spray device 58.

The small pressure tank 42 eliminates the exposure of the mixed solution to the pumping components and the auxiliary components located within the first fluid delivery system 24 such as first valves 28, second valves 30, conduits, hoses or passageways 32, pumps 34, pressure transducers 36, pressure relief valves 38 and second check valves 50 and allows small amounts of liquids or fluids held in holding tanks 20 to be selectively mixed at the discretion of the end-user. As previously mentioned, prior art mixing systems require routine cleaning and maintenance because the mixed solution has a finite life span and requires more frequent cleaning of the pumping components and the auxiliary components such as first valves 28, second valves 30, conduits, hoses or passageways 32, pumps 34, pressure transducers 36, pressure relief valves 38 and second check valves 50 that may come in contact with the mixed solution. The present invention which does not have mixed solution contacting such elements reduces the amount of cleaning and maintenance that is needed for the first fluid delivery system 24. As such, the first fluid delivery system 24 may be easily cleaned with any aqueous or organic liquid or fluid known in the art which is suitable for dissolving or releasing liquids or fluids disposed within the first fluid delivery system 24.

The mixer 40 is coupled to a first check valve 48 which separates the contents of the pressure tank 42 and the mixer 40. The mixer 40 is also coupled to a plurality of second check valves 50 which separate the mixer 40 from the first fluid delivery system 24. With the present invention, after the liquids or fluids have been mixed, the mixed solution is flowed from pressure tank 42 through a second fluid delivery system 52 which may contain additional elements, including, by way of example and not limitation, conduits, hoses, passageways, one or more filters 54 or one or more flow sensors 56. Spray devices 58 are coupled to pressure tank 42, filters 54, flow sensors 56 and are in fluid communication with the second fluid delivery system 52 and the pressure tank 42. The small size of the pressure tank 42 and the small amount of mixed solution stored therein allows the second fluid delivery system 52 to be easily cleaned with any aqueous or organic liquid or fluid known in the art which is suitable for dissolving or releasing mixed solution disposed within the second fluid delivery system 52.

The pressure generated by the pumps 34 provide enough pressure to the liquids or fluids in the first fluid delivery system 24 to overcome the pressure in the pressure tank 42 where a small amount of the mixed solution is stored. The relieving type pressure regulator 46 coupled to the pressure tank 42 selectively controls the pressure that flows the mixed solution from the pressure tank 42 through the second fluid delivery system 52. The pressure regulator 46 is a relieving type to allow for relieving pressure due to the changing volume of mixed solution in the pressure tank 42 as well as to relieve the higher pressure generated by pumps 34 to flow the liquids or fluids held in the holding tanks 20 into the pressure tank 42. The filters 54 remove contaminants from the mixed solution flowed from the pressure tank 42 through the second fluid delivery system 52. The mixed solution then flows through fluid flow sensors 56 which monitor the flow rate of the mixed solution. The fluid flow sensors 56 allow the end-user to selectively monitor the flow rate of the mixed solution from the spray devices 58. By monitoring the flow rate of the mixed solution from the spray devices 58, the end-user can identify changes in the amount or weight of mixed solution that is dispensed onto each can end 10 (e.g., blockages, line failures, etc.). The mixed solution then flows to the rotating or translating spray devices 58 attached to a spray machine which are rotating or translating in a circular or elliptical pattern and dispensing mixed solution on the can ends 10.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereto.

What is claimed is:

1. A mixing apparatus for the repair of coating adhered on a can end, comprising:

a plurality of holding tanks in fluid communication with a first fluid delivery system and a single mixer, the first fluid delivery system comprising a plurality of individual conduits;

a pressure tank in fluid communication with the single mixer; and a spray device in fluid communication with a second fluid delivery system and the pressure tank, wherein a plurality of liquids or fluids are flowed through the first fluid delivery system, each of said liquids or fluids being independently delivered from a corresponding one of said holding tanks to the single mixer via a corresponding one of said individual conduits, wherein the plurality of liquids or fluids are mixed in the single mixer to yield a mixed solution which is flowed to the pressure tank, and wherein the mixed solution is flowed from the pressure tank through the second fluid delivery system and dispensed on the can end.

2. The mixing apparatus of claim 1, wherein the first fluid delivery system further comprises additional elements.

3. The mixing apparatus of claim 2, wherein the additional elements are selected from the group consisting of valves, conduits, hoses, passageways, pumps, pressure transducers, pressure relief valves and check valves.

4. The mixing apparatus of claim 1, wherein the second fluid delivery system further comprises additional elements.

5. The mixing apparatus of claim 4, wherein the additional elements are selected from the group consisting of conduits, hoses, passageways, filters and flow sensors.

6. The mixing apparatus of claim 1, wherein a relieving type pressure regulator is coupled to the pressure tank.

7. The mixing apparatus of claim 1, wherein a check valve separates the pressure tank and the mixer.

8. The mixing apparatus of claim 1, wherein a plurality of check valves separate the mixer from the first fluid delivery system.

9. The mixing apparatus of claim 1, wherein each of the plurality of holding tanks is at atmospheric pressure, thereby allowing the holding tanks to be continuously replenished with the liquids or fluids while the mixing apparatus is operating.

10. A mixing apparatus for the repair of coating adhered on a can end, comprising:

a plurality of holding tanks in fluid communication with a first fluid delivery system and a single mixer, the first fluid delivery system having a plurality of valves coupled to the holding tanks, wherein the valves selectively flow liquids or fluids held in the holding tanks into the first fluid delivery system, the first fluid delivery system having a plurality of individual conduits and a plurality of pumps, wherein the pumps pump the liquids or fluids to flow the liquids or fluids into the single mixer, each of said liquids or fluids being independently delivered from a corresponding one of said holding tanks to the single mixer via a corresponding one of said individual conduits;

a pressure tank in fluid communication with the single mixer;

a relieving type pressure regulator coupled to the pressure tank; and a spray device in fluid communication with a second fluid delivery system and the pressure tank, wherein the plurality of liquids or fluids are mixed in the single mixer to yield a mixed solution which is flowed into the pressure tank, and wherein pressure in the pressure tank flows the mixed solution through the second fluid delivery system and dispenses the mixed solution on the can end.

11. The mixing apparatus of claim 10, wherein the first fluid delivery system further comprises additional elements.

12. The mixing apparatus of claim 11, wherein the additional elements are selected from the group consisting of conduits, hoses, passageways, pressure transducers, pressure relief valves and check valves.

13. The mixing apparatus of claim 10, wherein the second fluid delivery system further comprises additional elements.

14. The mixing apparatus of claim 13, wherein the additional elements are selected from the group consisting of conduits, hoses, passageways, filters and flow sensors.

15. The mixing apparatus of claim 10, wherein a check valve separates the pressure tank and the mixer.

16. The mixing apparatus of claim 10, wherein a plurality of check valves separate the mixer from the first fluid delivery system.

17. The mixing apparatus of claim 10, wherein each of the plurality of holding tanks is at atmospheric pressure, thereby allowing the holding tanks to be continuously replenished with the liquids or fluids while the mixing apparatus is operating.

* * * * *